United States Patent [19]

Martin

[11] Patent Number: 4,640,235

[45] Date of Patent: Feb. 3, 1987

[54] APPARATUS FOR CONTROLLING THE COOLANT MEDIUM CIRCULATION OF AN INTERNAL COMBUSTION ENGINE

[75] Inventor: Hans Martin, Stuttgart, Fed. Rep. of Germany

[73] Assignee: Suddeutsche Kuhlerfabrik Julius Fr., Behr GmbH & Co. KG, Fed. Rep. of Germany

[21] Appl. No.: 779,102

[22] Filed: Sep. 23, 1985

[30] Foreign Application Priority Data

Oct. 6, 1984 [DE] Fed. Rep. of Germany ..... 3436702

[51] Int. Cl.[4] ..... F01P 11/02

[52] U.S. Cl. ..... 123/41.03; 123/41.27; 165/104.32

[58] Field of Search ..... 123/41.27, 41.02, 41.03, 123/41.54; 165/104.32, 104.27

[56] References Cited

U.S. PATENT DOCUMENTS 1,703,163 2/1929 Muir ..... 123/41.03

2,127,271 8/1938 Schenk ..... 123/41.03

4,478,178 10/1984 Pernet ..... 123/41.54

*Primary Examiner*—William A. Cuchlinski, Jr.

*Attorney, Agent, or Firm*—Barnes & Thornburg

[57] ABSTRACT

A device is provided for protecting the coolant circulation in an internal combustion engine, especially a motor vehicle engine, from excess pressure. A first pressure control valve is arranged in the upper region of a coolant-carrying tank and adjusted to a first opening pressure. A float is arranged in the tank which, in a sealing manner, can be engaged with a lead-in to the pressure control valve so that, in the case of an excessive rise of the coolant in the tank, the pressure control valve is not operative. The ejection of cooling water in the switch-off phase of a previously heated internal combustion engine is thereby prevented. In order to avoid an unacceptable increase of pressure in the coolant-circulating system, a second pressure control valve is provided which is designed for a higher opening pressure than the first one. As a result, the coolant-circulating system is protected from excessive pressures.

20 Claims, 2 Drawing Figures

APPARATUS FOR CONTROLLING THE COOLANT MEDIUM CIRCULATION OF AN INTERNAL COMBUSTION ENGINE

BACKGROUND AND SUMMARY OF THE INVENTION

This invention relates to a device for protecting the coolant circulation of an internal combustion engine, such as a motor vehicle engine, from excess pressure. The device includes a pressure control valve arranged in the upper region of a coolant-conducting tank and adjusted to an opening pressure $p_1$.

The pressure control valve of a coolant circulating system of the initially mentioned type is conventionally adjusted to an opening pressure of about 1.1 to 1.15 bar. When the pressure in the coolant-circulating system exceeds this value, coolant, gases or water vapor may be discharged through this pressure control valve. When an internal-combustion engine has been operated for a certain time and has thus been heated up and subsequently switched off, vapor may be created by local overheating, for example, at the cylinder heads. When the coolant circulation is interrupted, the forming vapor cannot escape. The volume of fluids in the tank will be increased by this vapor formation resulting in the danger that coolant will be ejected via the pressure control valve. The control valve will then be unavailable for normal operation. In order to reliably prevent the ejection of coolant in the switch-off phase of an internal combustion engine operation, it would be possible to protect the coolant circulation by means of a higher excess pressure, i.e., to adjust the pressure control valve to a higher opening pressure. However, in the normal operation, this would result in increased stress on the parts of the cooling system.

An object of the present invention is to provide a device of the initially mentioned type wherein the ejection of coolant after the switching-off of a heated-up internal combustion engine is prevented.

Another object of the present invention is to prevent coolant ejection without having to protect the whole coolant-circulation system during operation by means of an increased excess pressure.

These and other objects of the present invention are attained by the arrangement of a float in the tank which is assigned to an admission means of the pressure control valve in a sealing manner.

According to the present invention, in the case of a formation of vapor because of local overheating and the accompanying increase in volume, the coolant level rises in the tank and displaces the float. As a result, the float is positioned in a sealing manner upstream of the pressure control valve. Thus, there is no longer a direct connection between the interior of the coolant-holding tank and the pressure control valve and coolant cannot be ejected. By means of the increased excess pressure that is now accomodated by the coolant-circulation system, a further formation of vapor is now essentially prevented. Sometime after the switching-off of the internal combustion engine, the coolant level in the tank will fall again because of cooling. The float will then disengage itself from its seat upstream of the pressure control valve so that the cooling-water circulation will again be protected by means of the opening pressure $p_1$ at which the pressure control valve is actuated.

In a further development of the invention, a second pressure control valve is provided which is designed for a higher opening pressure $p_2$ than the first pressure control valve. The increased opening pressure of the second pressure control valve which, for example, is 1.5 bar, prevents an excessive pressure build-up in the coolant circulating system when vapor formation occurs during the switch-off phase of the internal combustion engine. The opening pressure $p_2$ of the second pressure control valve is advantageously selected in such a way that, on the one hand, the danger of damage because of increased stress to the parts of the coolant-circulating system because of the high pressure is precluded. On the other hand, during this switch-off phase of the internal combustion engine, the formation of vapor is reduced and the ejection of coolant is prevented.

In an advantageous development of the invention, it is provided that the second pressure control valve is installed in the float and connects the admission means to the first pressure control valve with the tank. The second pressure control valve is thus connected in series with the first pressure control valve. Thus an addition of pressure is created between the opening pressures of both pressure control valves so that the second pressure control valve must be designed only with respect to the difference between the opening pressure of the first pressure control valve and the desired increased opening pressure. In the case of a formation of vapor during the switch-off phase of the internal combustion engine, i.e., when there is the danger of an ejection of coolant, the coolant circulation is thus protected via the added opening pressures.

In a further development of the invention, it is provided that the float is guided in a cage arranged in the tank. Thus it is ensured that the float always moves in a defined path. In a further development, it is provided that the float, with the second pressure control valve and with the cage, is designed as an insert that, in a sealing manner, can be inserted into an opening of the tank and contains the admission means to the first pressure control valve. This insert forms a structural unit that can be preassembled and inserted into the tank as a whole.

In a further development of the invention, it is provided tha the insert is inserted into a filler connection piece of the tank and has a valve seat for the valve disk of the first pressure control valve that is held by means of a bayonet-type cap. Thus a structural unit is formed from both pressure control valves which as such is mounted at the tank. The filler connection piece of the tank may then have a relatively simple design.

In a further development of the invention, it is provided that the insert has a tube-shaped projection connecting to the admission means to the first pressure control valve. A float is guided in said projection with play, and the end of said projection which points into the tank is subdivided into individual legs by means of axial slots. In this manner, a simple cage for the guiding of the float is obtained, on the one hand, while, on the other hand, the tank is protected from overfilling. As long as the float is located in the area of the slots of the projection, a relatively large opening cross-section to the tank is free, through which the coolant may enter the tank. When the float reaches the unslotted area of the projection, due to the rising liquid level, only a small free cross-section remains so that a further entry of coolant into the tank is at least considerably impaired.

In an advantageous development of the invention, it is provided that the legs of the projection, at their free ends, are equipped with stops that are radially aimed toward the inside of the projection. When the float is inserted, the legs are elastically spread apart slightly. After the insertion of the float, the legs secure the lowest position of the float. The float thus, in a simple manner, can be fitted together with the insert to form a structural unit.

In a further development of the invention, a throttle opening bypassing the float is provided from the interior of the tank in front of the first pressure control valve. Thus it is achieved that when the coolant-circulating system is overfilled, the pressure in the cooling-water circulating system can decrease over a predeterminable time period to the opening pressure of the first pressure control valve. Accordingly, even in the case of overfilling, the coolant-circulating system is not subjected to increased pressure over a longer period of time. The cross-section of the throttle opening is selected in such a way that during the switch-off phase of the engine no coolant ejection takes place in the case of a normal charge through the throttle opening. In the case of a first embodiment, the leading-in of the throttle opening is arranged in the area of the highest point of the tank. As a result, the excessive pressure is decreased by means of the discharge of gas or water vapor. In the case of another embodiment of the invention, it is provided that the leading-in of the throttle opening is arranged at a point that immerses in the cooling water. As a result, the pressure is decreased by the ejection of coolant, in which case, however, only that quantity of coolant is ejected that may be present because of a possible overfilling.

Other objects, advantages and novel features of the present invention will become apparent from the following detailed description of the invention when considered in conjunction with the accompanying drawings.

DETAILED DESCRIPTION OF THE DRAWINGS

Figure 1:
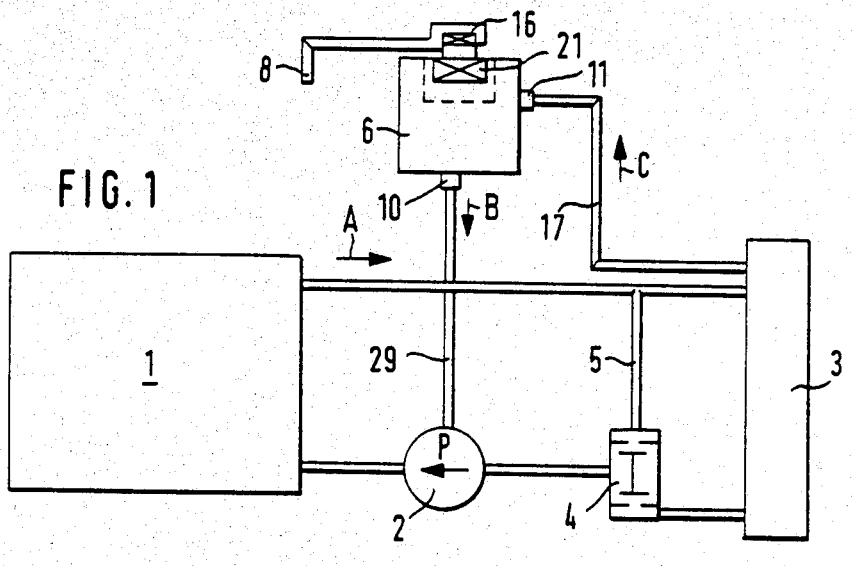
FIG. 1 is a diagrammatic representation of a coolant-circulating system of an internal combustion engine of a motor vehicle having an equalizing tank arranged at the highest point of the system in accordance with the present invention.

FIG. 1 shows an internal combustion engine 1 having an internal coolant circulation. Water provided with an antifreeze agent is conventionally used as the coolant. A radiator is connected with the coolant-circulating system of the internal combustion engine 1 via pipes in which a cooling pump 2 is arranged. The cooling pump 2 delivers the coolant to the internal combustion engine 1 from which it flows to the radiator 3 in the direction of the Arrow A. A short-circuit line 5 is arranged in front of the radiator 3 which via a thermostatic valve 4 is connected with a pipe leading into the internal combustion engine 1. An equalizing tank 6 is arranged in the bypass flow between the radiator 3 and the coolant pump 2. The equalizing tank 6 is located at the highest point of the coolant-circulating system. The inlet 11 of the equalizing tank 6 is connected with the highest point of the radiator 3 via a pipe 17. The outlet 10 of the equalizing tank 6 is connected to the suction side of the cooling pump 2 via a pipe 29. The coolant is degassed in the equalizing tank 6, i.e., the vapor or gas enclosed in the coolant, in an emulsion, reaches the equalizing tank 6 in which it is separated from the coolant and discharged via an overflow 8.

The coolant-circulating system, with respect to indicated opening pressures, is protected from excess pressure by means of two pressure control valves 16 and 21. The pressure control valve 16 acts in normal operation and is adjusted, for example, to an opening pressure p of about 1.15 bar. The pressure control valve 21 which operates only in certain operational conditions is adjusted to a higher opening pressure p such as 1.5 to 1.6 bar. In the case of the shown embodiment, the excess pressure protection system consisting of the two pressure control valves 16 and 21 is arranged at the equalizing tank 6. Naturally, it may also be possible to provide these at a different point of the coolant-circulating system, especially at the top side of the radiator 3, for example, when no separate equalizing tank 6 is provided in the coolant-circulating system.

An insert 30 containing the two pressure control valves 16 and 21 is fitted into the filler connection 12 of the equalizing tank 6, said insert 30 having an essentially cylindrical outside contour. The insert 30, by means of a flange 32, reaches around the edge of the flange 33 of the filler connection 12 and is secured to be locked at it. For sealing purposes, two sealing rings 39 are arranged between the filler connection 12 and the insert 30. A bayonet-type cap 31 is detachably mounted on the flange 32 of the insert 30. This bayonet-type cap 31 carries a valve plate 13 of the first pressure control valve 16. The valve plate 13 is guided on a bolt 40 of the bayonet-type cap 31 so that it can be slid in an axial direction and is loaded by means of a pressure spring 14. A valve seat 15 is disposed to engage the valve plate 13. This valve seat 15 is formed by a contracted step of the insert 30. Outside the valve seat 15, the insert 30 is connected with several axially directed openings 41 which lead to a surrounding ring-groove-shaped duct 42 to which an overflow 8 mounted on the filler connection 12 is connected. The pressure spring 14 of the first pressure control valve 16 is designed for an opening pressure in the range of about 1.15 bar. This pressure control valve 16 operates during the normal operation of the internal-combustion engine 1, i.e., the coolant-circulating system is designed for an excess pressure of about 1.15 bar. When a higher excess pressure occurs, the pressure control valve 16 will open so that gas or water vapor that is enclosed in the coolant may be discharged via the connecting openings 41, the duct 42 and the overflow 8.

The insert 30, by means of a tube-shaped projection 18, projects into the equalizing tank 6. The projection 18 which is annular in its upper part is subdivided into individual legs 34 in its lower area by means of axial slots. A float 19 is inserted into the projection 18. This float 19 is able to be inserted into the projection while the legs 34 are elasticly expanded. The ends of the legs 34 are provided with radially aimed stops 35 which prevent the float 19 from falling out. The float 19 is limited in an upward direction by a valve seat 27 having a smaller diameter than the tube-shaped projection 18. The valve seat 27 is located at an entrance of a cylindrical duct leading to the valve seat 15 of the first pressure control valve 16. The float 19 having an upper side equipped with a sealing disk 26 is engageable with the valve seat 27 as the valve plate.

The float 19 is designed as a roller-shaped hollow part that is tightly closed toward the outside. If the danger of leakage should exist, it is advantageous to provide buoyant parts which may consist of a foam material within the hollow part of the float 19. The float 19 contains a second pressure control valve 21 which exposes or blocks a connection between the interior of the equalizing tank 6 and the first pressure control valve 16. This pressure control valve 21 has a valve plate 23 the edged border of which rests from the outside against the sealing disk 16 which is arranged at the upper side of the float 19. The float 19 is equipped with a continuous duct 24 to which an opening of the sealing disk 26 is assigned and which is closed by the valve plate 23. A projection 36 is mounted at the valve plate 23. This projection 36 is led through the duct 24 of the float. At the end of projection 36 which projects out of the other side of the float, a conical locking spring 22 is disposed which is supported by a retaining ring 43 mounted on the projection 36. The other end of the locking spring 22 supports itself at the bottom side of the float 19. At the upper side and the lower side of the float 19, webs are arranged that project toward the inside into the duct 24. These webs are used for radial guiding the projection 36.

The float 19 that is guided in the projection 18 of the insert 30 has several functions. In one function, it acts as a protecting means against overfilling. Line 17*a* indicates the liquid level up to which the coolant-circulating system should be filled in the cold condition. Up to this liquid level 17*a*, the float 19 is in the lowest position in which it rests on the stops 35. The axial slots of the projection 18 are dimensioned in such a way that they are sufficiently longer than the height of the float 19 so that they expose a sufficient cross-section when coolant is replenished via the insert 30, while the bayonet-type cap 31 is removed. When the coolant in the equalizing tank 6 rises over the level 17*a*, the float 19 is lifted up and, with its upper edge, reaches the area of the tube-shaped projection 18 that is no longer slotted. As a result, the flow-in cross-section to the equalizing tank 6 is limited to the play between the upper edge of the float 19 and the projection 18, so that it is significantly reduced. During the continued replenishing, coolant collects in the duct above the float until the coolant flows out via the overflow 8. Even if the handling is not very careful, this is a sufficiently reliable sign that the coolant supplying operation should be interrupted. However, the play between the float 19 and the projection 18 will still be large enough so that a perfect degassing can take place via the first pressure control valve 16. By means of the tube-shaped projection 18 projecting into the equalizing tank 6, it is also ensured that an air cushion definitely exists in the upper area of the equalizing tank 6.

The coolant-circulating system is designed in such a way that on the basis of the heating of the coolant, the elevated coolant level 17*b* is adjusted at which the float 19 is still located at a sufficient distance to the valve seat 27. In this operating condition, only the first pressure control valve 16 is in operation, i.e., the coolant-circulating system is protected with respect to the opening pressure of the pressure control valve 16.

When the internal combustion engine 1 is switched off after an operation, especially after an operation with an increased output, such as a drive through the mountains, etc., the coolant circulation is interrupted. The danger exists that at overheated points within the guiding means of the coolant of the internal-combustion engine vapor bubbles are formed which result in an enlargement of volume of the coolant in the coolant-circulating system. The coolant will then rise in the equalizing tank 6 to an elevated level which is represented, for example, by the line 17*c*. The float 19 will then be moved in upward direction to such an extent that it rests against the valve seat 27 by means of its sealing disk 26. As a result, the pressure control valve 16 is separated from the coolant circulating system so that it is not in operation. The possible excess pressure in the coolant-circulating system will then no longer be limited by the pressure control valve 16. By blocking the first pressure control valve 16, it is thus prevented that, when the volume is enlarged further by means of the formation for vapor bubbles, etc., coolant is ejected via the first pressure control valve 16.

An increased excess pressure may adjust itself within the coolant-circulating system which has the result that a further formation of vapor bubbles is curtailed. In this case, the possible excess pressure is determined by the second pressure control valve 21 which is designed for a corresponding opening pressure. Since the first pressure control valve 16 and the second pressure control valve 21 are arranged in series behind one another, this opening pressure is determined from the addition of the opening pressures of the first pressure control valve 16 and of the second pressure control valve 21. When, for example, for the described condition after the switching-off of the internal-combustion engine, an excess pressure of 1.6 bar is to be permitted, and the first pressure control valve is designed for an opening pressure of 1.15 bar, the second pressure control valve 21 will be designed for an opening pressure of an additional 0.45 bar by means of a corresponding dimensioning of the locking spring 22.

In the case of an overfilling of the coolant-circulating system, where the float 19 is located in the shown position making the pressure control valve 16 inoperational, in order to prevent that the elevated excess pressure exists in the coolant-circulating system over an extended period of time, a throttle opening or bypassing device 28 is provided. This opening while bypassing the float 19 and the second pressure control valve 21, connects the interior of the equalizing tank 6 with the first pressure control valve 16. In the case of the shown embodiment, this throttle opening consists of a duct 28 penetrating the valve plate 23 and the projection 36. The cross-section of this throttle opening, i.e. of the duct 28, is dimensioned in such a way that no coolant is ejected through this throttle opening in the switch-off phase when the danger of the formation of bubbles exists, but that, after a predeterminable time period, the reduction of pressure to the opening pressure of the first pressure control valve 16 is ensured. In the case of overfilling, the projection 36 with the duct 28 serving as the throttle opening dips into the coolant so that the possible decrease of pressure is caused by the ejection of coolant, reducing the overfilling.

Figure 2:
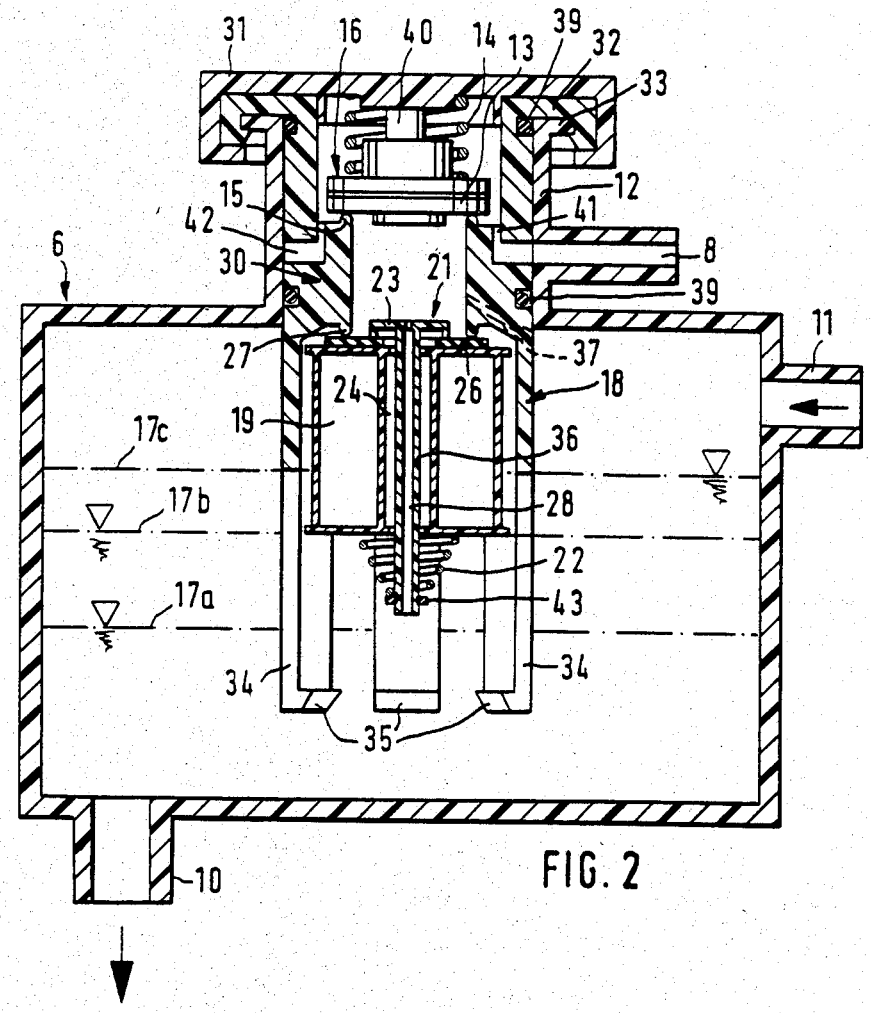
FIG. 2 is an enlarged section through the equalizing tank of FIG. 1 which is equipped with a device according to the present invention

As a modification of the explained emobodiment, it is provided that a throttle opening or bypassing device which in FIG. 2 is shown by means of an interrupted line, is led through the insert 30 directly from the highest point of the equalizing tank 6 to the area in front of the first pressure control valve 16. In this case, the reduction of pressure, in the case of an overfilling, takes place by the escape of vapor or gas or air via the throttle opening 37.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A device for protecting coolant circulation of an internal combustion engine from excess pressure including a first pressure control valve capable of selectively communicating a coolant-carrying tank with overflow means for removing coolant from the tank, comprising:

float means disposed in the tank upstream of said first pressure control valve for preventing a flow of coolant from the tank to the first pressure control valve and overflow means in response to a rising coolant level in the tank.

2. A device according to claim 1, wherein the tank includes valve seat means, said float means being engageable with said valve seat means.

3. A device according to claim 1, comprising second pressure control valve means disposed in said tank upstream of said first pressure control valve means with respect to said overflow means, said first pressure control valve means being actuated at a first tank pressure, said second pressure control valve means being actuated at a greater tank pressure than said first tank pressure.

4. A device according to claim 3, wherein said float means includes said second pressure control valve means, said second pressure control valve means being capable of selectively communicating said tank with said first pressure control valve means.

5. A device according to claim 4, wherein said second pressure control valve means includes spring-biased valve plate means biased against a top side of said float means.

6. A device according to claim 5, wherein said top side of said float means includes valve seat means for engagement with said valve plate means.

7. A device according to claim 5, wherein said valve plate means includes projection means, said projection means being guided in an opening in said float means.

8. A device according to claim 7, wherein said projection means and said valve plate means comprise bypassing means for communicating said tank with said first pressure control valve means.

9. A device according to claim 1, wherein said tank includes tube-shaped projection means for guiding said float means.

10. A device according to claim 9, wherein said float means, said second pressure control valve means and said tube-shaped projection means are included in insert means, said insert means being capable of being inserted in an opening of said tank.

11. A device according to claim 10, wherein said tank means includes filler connection means for receiving said insert means, and said insert means includes first valve seat means engageable with said first pressure control valve means.

12. A device according to claim 11, wherein said first pressure control valve means includes valve plate means for engaging said first valve seat means.

13. A device according to claim 12, wherein said valve plate means is part of a bayonet-type cap.

14. A device according to claim 11, wherein the insert means includes insert flange means, and the filler connection means includes filler connection flange means, said insert flange means being engageable with said filler connection flange means.

15. A device according to claim 14, wherein said insert flange means extends around said filler connection flange means.

16. A device according to claim 10, wherein an end of said of tube-shaped projection extends into said tank, said end of said projection having axially extending slots, said slots dividing said end into leg means.

17. A device according to claim 16, wherein said leg means have stop means extending radially toward an inside portion of said tube-shaped projection.

18. A device for protecting coolant circulation of an internal combustion engine from excess pressure including a pressure control valve capable of selectively communicating a coolant-carrying tank with overflow means for removing coolant from the tanks, comprising:

float means disposed in the tank for preventing a flow of coolant from the tank to the overflow means in response to a rising coolant level in the tank: and bypassing means for communicating said tank with said first pressure control valve means, said bypassing means being capable of bypassing said float means.

19. A device according to claim 18, wherein said bypassing means is disposed at a top portion of said tank.

20. A device according to claim 18, wherein a portion of said bypassing means is immersed in said coolant.

* * * * *